US006824036B2

(12) United States Patent
Walter

(10) Patent No.: US 6,824,036 B2
(45) Date of Patent: Nov. 30, 2004

(54) ADAPTER FOR NAIL GUN FOR INSTALLING SIDING

(76) Inventor: William V. Walter, 593 Cheaneys Bridge Rd., Dunnsville, VA (US) 22454

( * ) Notice: Subject to any disclaimer, the term of this patent is extended or adjusted under 35 U.S.C. 154(b) by 0 days.

(21) Appl. No.: 10/199,644

(22) Filed: Jul. 18, 2002

(65) Prior Publication Data

US 2004/0011845 A1 Jan. 22, 2004

(51) Int. Cl.[7] ..... B25C 5/10

(52) U.S. Cl. ..... 227/120; 227/119; 227/139; 227/140; 227/154

(58) Field of Search ..... 227/119, 120, 227/140, 146, 152, 154, 139

(56) References Cited

U.S. PATENT DOCUMENTS

| | | | | | |
|---|---|---|---|---|---|
| 3,554,246 | A | * | 1/1971 | Halstead | 81/434 |
| 5,238,167 | A | | 8/1993 | Howard et al. | 227/110 |
| 5,261,588 | A | | 11/1993 | Lin | 227/110 |
| 5,465,499 | A | | 11/1995 | LaPlante | 33/647 |
| 5,634,583 | A | | 6/1997 | McGuinness et al. | 227/120 |
| 5,743,455 | A | * | 4/1998 | Holliday | 227/142 |
| 5,988,026 | A | * | 11/1999 | Reckelhoff et al. | 81/434 |
| 6,145,725 | A | * | 11/2000 | Omli | 227/18 |
| 6,302,310 | B1 | * | 10/2001 | Lamb | 227/119 |
| 6,481,610 | B1 | * | 11/2002 | Liu et al. | 227/18 |
| 6,543,666 | B1 | * | 4/2003 | Huang | 227/18 |

* cited by examiner

*Primary Examiner*—Scott A. Smith
*Assistant Examiner*—Gloria R. Weeks
(74) *Attorney, Agent, or Firm*—Armstrong, Kratz, Quintos, Hanson & Brooks, LLP

(57) ABSTRACT

An adapter attached to a fastener driving tool for installing siding on a structure. The adapter has a front face and a back face with an opening formed therebetween. A cavity is formed in the back face and a face plate of the fastener driving tool is received in the cavity. A jaw is formed on the front face of the adapter. The jaw on the adapter is abutted to the lateral ridge on the siding and the adapter is aligned with a selected lateral slot in the siding. The fastener is driven into the lateral slot with the head of the fastener spaced a predetermined distance from the structure.

11 Claims, 7 Drawing Sheets

ADAPTER FOR NAIL GUN FOR INSTALLING SIDING

BACKGROUND OF THE INVENTION

1. Field of the Invention

The present invention relates to a device and method to use a roof fastener driving tool for the installation of siding and more particularly to an adapter for attachment to fastener driving tools from any one of several manufacturers which is used to rapidly and automatically install siding on a structure.

2. Description of Related Art

Siding used in the construction industry which is installed on the side of a structure may be formed of aluminum or plastic such as vinyl. The siding is a long strip of material having a lateral ridge near the top along the entire length of the strip. Above the lateral ridge there is a segment having a plurality of spaced-apart lateral slots formed therein. At the present time, the strip is held against the structure and a construction employee places the point of fastener with a head (such as a nail) in one of the lateral slots. With a hammer, the nail is driven in until the head is at approximately a predetermined distance from the structure. The nail should not be driven in to be flush with the structure but there should be a space between the slots in the siding and the structure. This is important because the siding must be capable of moving slightly when the siding expands and contracts during changes in temperature in the weather cycle. If the siding is firmly anchored to the structure, the siding buckles and deforms. In the present usage, the operator frequently does not drive the nail into the structure properly. The head of the nail may be too far from the structure allowing the siding to sag, providing insufficient protection to the structure. If the head is too close to the structure, the siding may not expand or contract without damage. A major problem is that the above-identified installation of siding is a slow process which requires large expenditures of man-hours. In addition, there is the problem of the hammer of the operator hitting the siding on the slots or on the lateral ridge immediately below the slots. In either situation, the siding may be damaged and fail to protect the structure.

The installation of shingles on the roof of a structure was also costly and slow until the advent of the fastener driving tool to permit an operator to very rapidly and efficiently install shingles on a roof. In U.S. Pat. No. 5,238,167 Howard et al disclose a positioning mechanism for a pneumatically-powered combustion-powered fastener-driving tool including a nosepiece, and a mechanism for positioning the tool relative to an opening in a workpiece to be fastened to another workpiece. The device is used for framing lumber. In U.S. Pat. No. 5,261,588, Lin discloses an auxiliary slidable abutment pivotally mounted on the nail carriage of a nailing gun. The abutment is slidable and can be locked at any given point of its sliding course. The nailing gun can drive the nails with precision into a workpiece at a prescribed angle. It is used for toe nailing framing lumber. La Plante in U.S. Pat. No. 5,465,499 discloses a tool for installing beveled wooden siding and for maintaining the spacing in exposed siding. Holliday in U.S. Pat. No. 5,743,455 discloses an adapter for a fastener driving tool to control the depth of penetration of a fastener used in installing siding. However, the need exists for controlling the distance of the head of the fastener from the structure, not the depth to which the fastener is driven.

Thus, there is a need for a tool which provides the ability for an operator to install siding more rapidly, more economically and without damage to the siding.

BRIEF SUMMARY OF THE INVENTION

It is an object of the present invention to provide a relatively simple adapter for a fastener driving tool so the tool can be used for installation of siding.

It is a further object of the present invention to provide a method for rapidly and economically installing siding.

In accordance with the teachings of the present invention, there is disclosed an adapter attached to a fastener driving tool for installing siding on a structure. The fastener driving tool has a movable driver. The fastener driving tool has a face plate on an end thereof, the face plate having an opening therein. The adapter has a top, a bottom, a front face, an opposite back face and a thickness between the front face and the back face. An opening is formed in the adapter between the front face and the back face, the opening being aligned with the opening in the face plate. A plurality of fasteners are stored within the fastener driving tool, each fastener having a head. Means are provided for automatically sequentially introducing one of the plurality of fasteners to the movable driver. Each fastener has a head and a sharpened shank. A trigger is connected to the driving tool. Activating the trigger moves the movable driver against the head of the fastener to drive the shank of the fastener through the opening in the face plate, through the opening in the adapter and through a slot in the siding. The head of the fastener is stopped at a predetermined distance from the structure.

In further accordance with the teachings of the present invention, there is disclosed an adapter for use with a fastener driving tool for installation of siding on a structure. The adapter has a body having a top, a bottom, a front face, a back face, and a thickness between the front face and the back face. A jaw is formed on the front face of the body near the bottom thereof. A cavity is formed in the back face of the body. A through opening is provided between the front face and the back face of the body communicating with the cavity. Means are provided for removably attaching the adapter to the fastener driving tool.

In another aspect there is disclosed a method of installing siding on a structure. Siding is provided having a lateral ridge formed thereon. A plurality of spaced-apart lateral slots are formed above the lateral ridge. A fastener driving tool is provided having a plurality of fasteners stored therein. Each fastener has a head and a sharpened shank. The fastener driving tool has a movable driver. The fastener driving tool has a face plate on an end thereof. The face plate has an opening therein. A trigger is connected to the fastener driving tool to activate the movable driver. An adapter is provided having a front face and an opposite back face. The adapter has a cavity formed in the back face, and an opening is formed in the adapter between the front face and the back face. The opening in the adapter is aligned with the opening in the face plate. The adapter has a jaw formed on the front face of the adapter. The adapter is mounted on the face plate of the movable driver, wherein the face plate is received in the cavity in the back face of the adapter. The fastener driving tool is disposed on the siding such that the jaw on the adapter abuts the lateral ridge on the siding and the opening in the adapter is aligned with a selected one of the lateral slots in the siding. The fastener driving tool is triggered wherein the movable driver impacts the head of one of the fasteners and drives the fastener through the opening in the face plate, through the opening in the adapter and into the lateral slot in the siding, such that the head of the fastener is spaced apart a predetermined distance form the structure. The fastener driving tool is moved opposite another lateral slot in the siding. The jaw of the adapter is abutted to the lateral ridge on the siding and the fastener driving tool is triggered. The steps are repeated to install the siding automatically and rapidly, avoiding damage to the siding.

These and other objects of the present invention will become apparent from a reading of the following specification taken in conjunction with the enclosed drawings.

DESCRIPTION OF THE PREFERRED EMBODIMENTS

Figure 1:
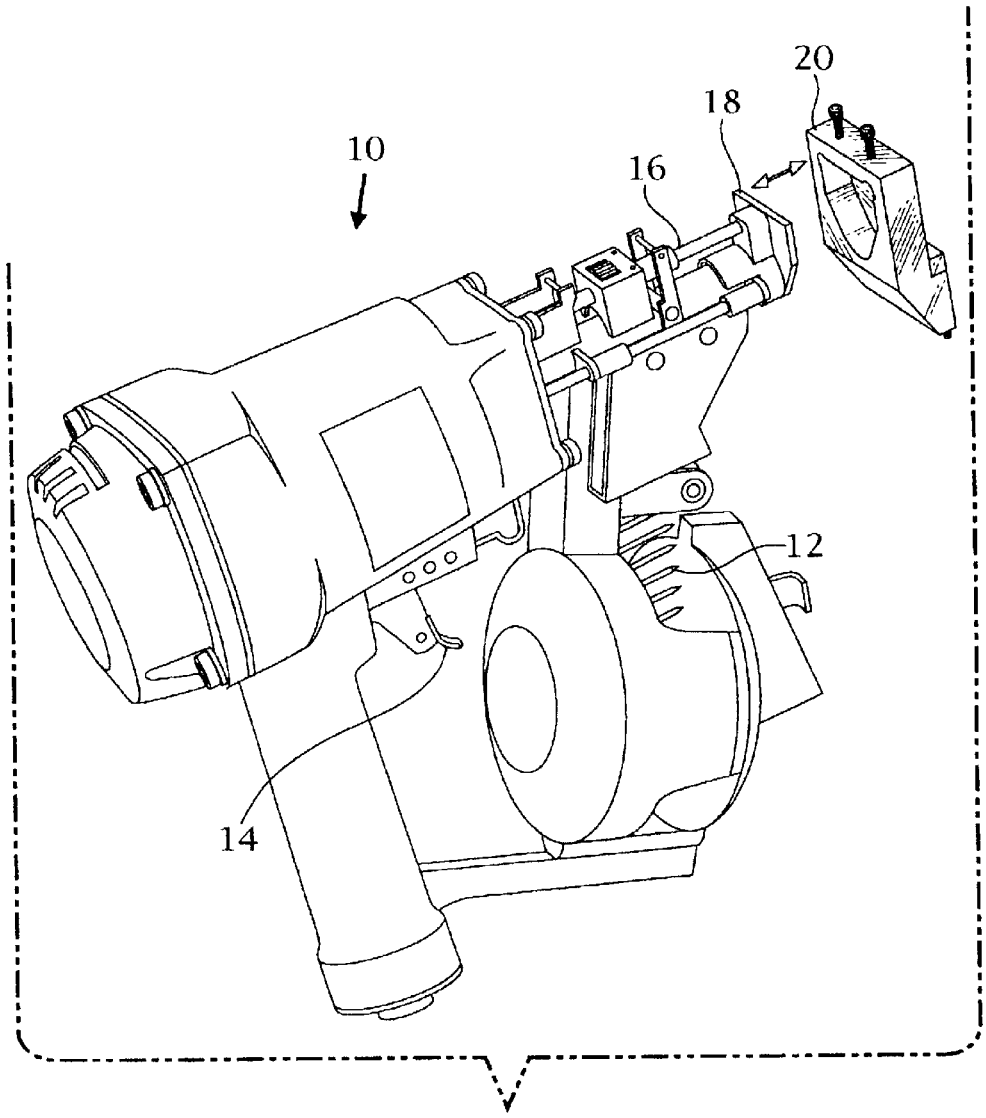
FIG. 1 is a perspective view of a fastener driving tool to which an adapter is to be attached.
Figure 2:
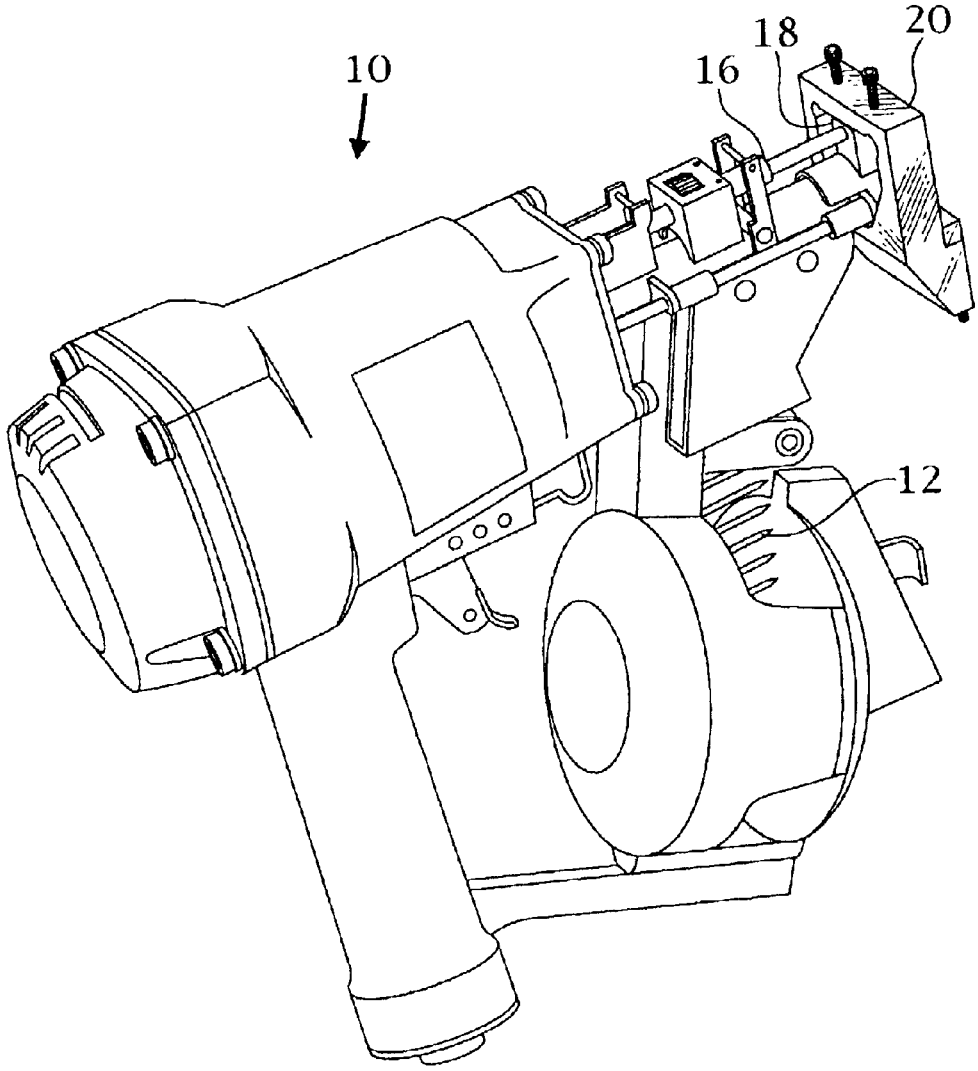
FIG. 2 is a perspective view of the adapter attached to the fastener driving tool.
Figure 3:
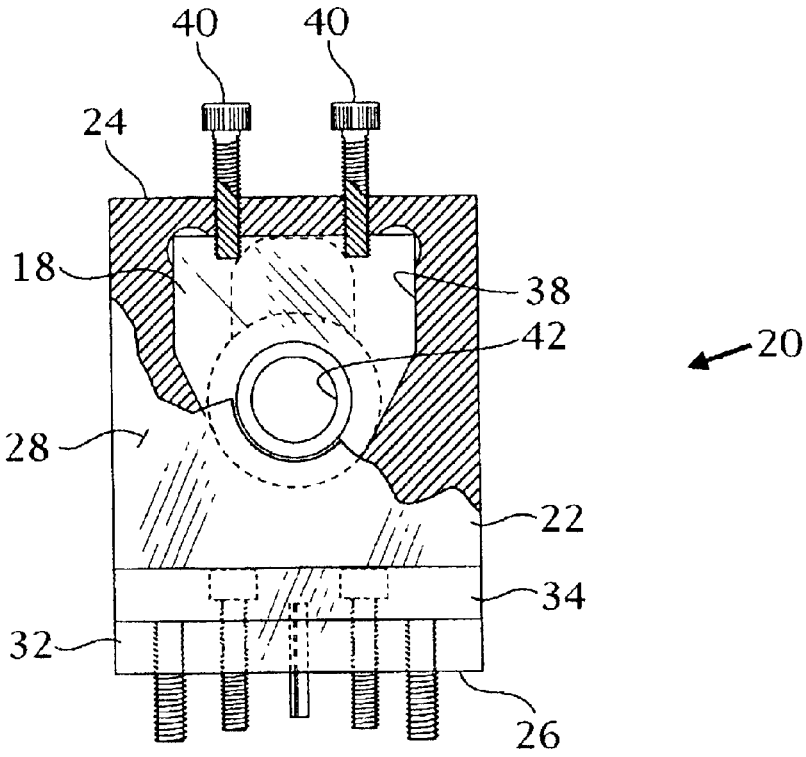
FIG. 3 is a partial cutaway top plan view of the front face of the adapter connected to the face plate of a typical fastener driving tool.
Figure 4:
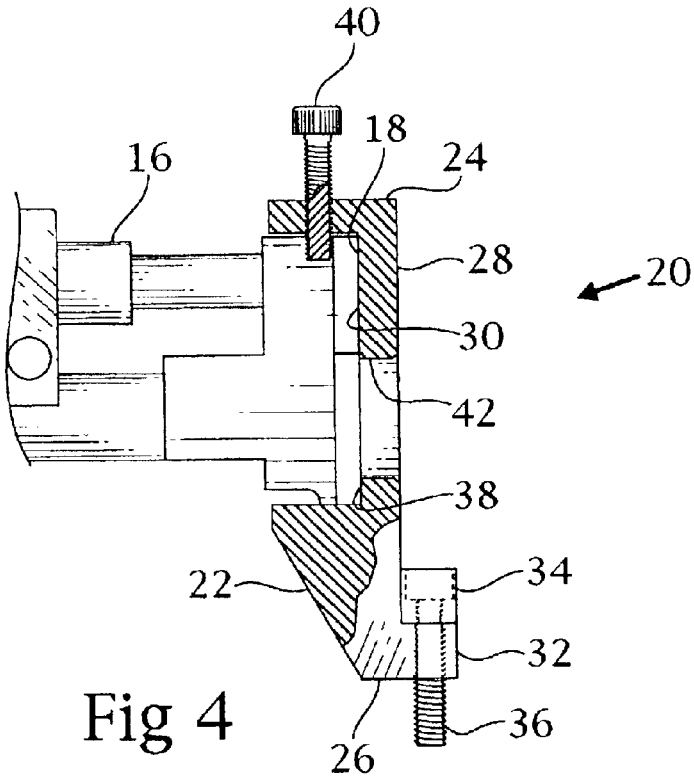
FIG. 4 is a partial cutaway side elevation view of the adapter connected to the face plate of a typical fastener driving tool.
Figure 7:
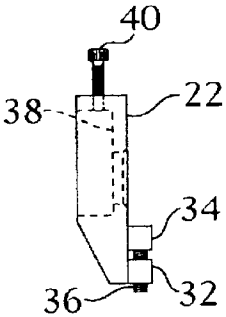
FIG. 7 is a side elevation view of the adapter of FIG. 5.
Figure 10:
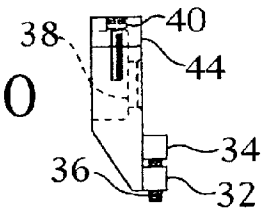
FIG. 10 is a side elevation view of the adapter of FIG.8.

Referring to FIGS. 1 and 2, a fastener driving tool 10 such as a "gun" used to install nails for roofing shingles has a plurality of fasteners 12 stored within the fastener driving tool 10. The fasteners 12 can be automatically and sequentially dispensed when a trigger 14 on the fastener driving tool 10 is activated. Activation of the trigger 14 also moves a hammer (movable driver) 16 towards an end of the fastener driving tool. The movable driver 16 impacts the head of one of the fasteners 12 and drives the fastener 12 through an opening in a face plate (shoe) 18 on an end of the fastener driving tool 10 until the head of the fastener 12 is approximately flush with the outer surface of the face plate 18. In the present invention, an adapter 20 is connected to the face plate 18.

As shown on FIGS. 2–17, the adapter 20 has a body 22 with a top 24, a bottom 26, a front face 28 and an opposite back face 30. The adapter has a thickness between the front face and the back face which is approximately equal to 3/16" although this thickness may vary if desired. On the bottom of the front face 28, a lip or jaw 32 is formed on the body protruding outwardly from the front face 28. Preferably, an adjustable jaw 34 is disposed on the upper side of the lip 32. At least one threaded fastener 36 connects the adjustable jaw 34 to the lip 32 such that the adjustable jaw 34 may be spaced apart from the lip 32 by a desired distance while the adjustable jaw 34 remains connected to the lip 32. Other means, known to persons skilled in the art, may be used to connect the adjustable jaw 34 to the lip 32. The function of the adjustable jaw 34 will be discussed below.

A cavity 38 is formed in the back face 30 of the body 12 of the adapter 20. The face plate 18 of the fastener driving tool 10 is received in the cavity 38 and cooperates with the cavity 38. At least one threaded fastener 40 passes through at least one cooperating threaded opening in the top 24 of the body 22 and secures the face plate 18 in the cavity 38 in the body 22. An opening 42 is formed in the thickness of the body 22 between the front face 28 and the back face 30. The opening communicates with the cavity 38 and is aligned with the opening in the face plate 18 when the face plate 18 is received in the cavity 38.

Since each manufacturer of a fastener driving tool 10 has a face plate 18 having a design and configuration which is unique for the manufacturer, the adapter 20 must have a corresponding unique cavity 38 in which the face plate 18 is received. Also, the body 22 and means for attaching the body to the face plate may be specifically made for a fastener driving tool made by a particular manufacturer. FIGS. 5–17 show adapters which have been designed for fastener driving tools made by Porter Cable (FIGS. 5–7), Stanley-Bostitch (FIGS. 8–10), Paslode (FIGS. 11–13), Craftsman (FIGS. 14–17) and SENCO (FIGS. 18–22) the most popular manufacturers of fastener driving tools.

Preferably, the adapter is formed from metal such as aluminum but could be formed from plastic or other materials known to persons skilled in the art.

The adapter for the Porter Cable tool (FIGS. 5–7) preferably is formed as a single piece.

Because of the shape of the face plate 18 on the Stanley-Bostitch tool, the adapter (FIGS. 8–10) is formed from two pieces. A cap 44 is connected to the body 22 by the threaded fastener 40. The cavity 38 extends into the cap 44 and the face plate 18 is received in the cavity 38 in both the body 22 and the cap 44.

Figure 13:
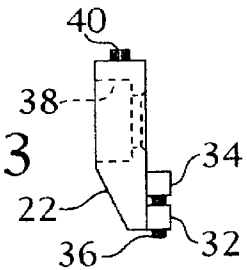
FIG. 13 is a side elevation view of the adapter of FIG. 11.
Figure 6:
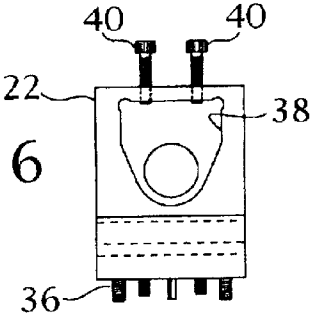
FIG. 6 is a plan view of the back face of the adapter of FIG. 5.
Figure 9:
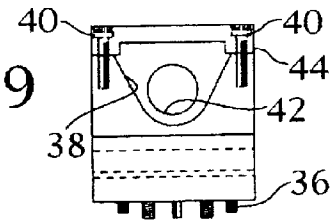
FIG. 9 is a plan view of the back face and the adapter of FIG.8.
Figure 12:
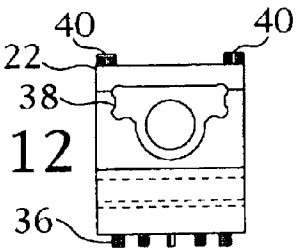
FIG. 12 is a plan view of the back face of the adapter of FIG. 11.
Figure 5:
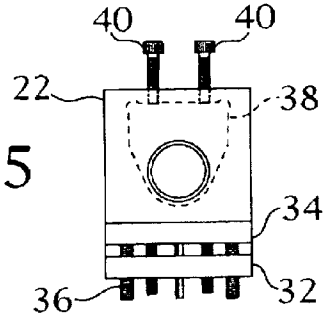
FIG. 5 is a plan view of the front face of an adapter for a fastener driving tool made by Porter Cable.
Figure 8:
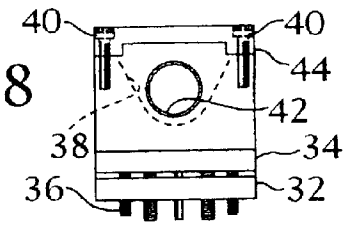
FIG. 8 is a plan view of the front face of an adapter for a fastener driving tool made by Stanley-Bostitch.
Figure 11:
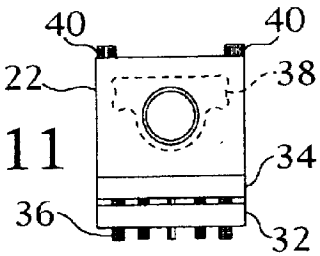
FIG. 11 is a plan view of the front face of an adapter for a fastener driving tool made by Paslode.
Figure 17:
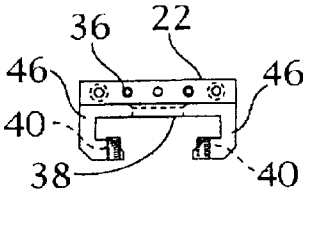
FIG. 17 is an end view of the bottom of the adapter of FIG. 14.
Figure 16:
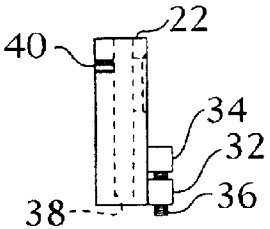
FIG. 16 is a side elevation view of the adapter of FIG. 14.
Figure 15:
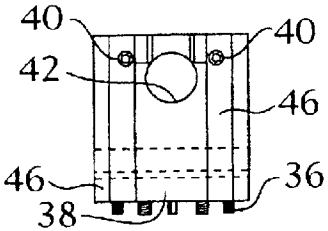
FIG. 15 is a plan view of the back face of the adapter of FIG. 14.
Figure 14:
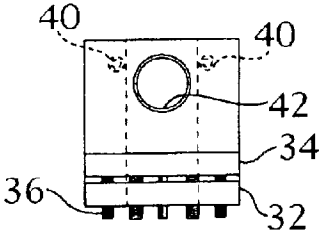
FIG. 14 is a plan view of the front face of an adapter for a fastener driving tool made by Craftsman.
Figure 22:
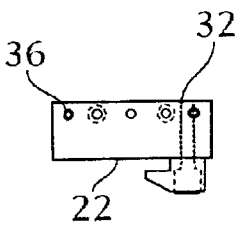
FIG. 22 is an end view of the bottom of the adapter of FIG. 20.
Figure 21:
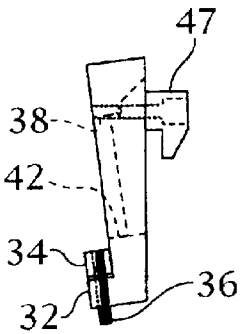
FIG. 21 is a side elevation view of the adapter of FIG. 18.

The shape of the face plate 18 on the Paslode tool also requires the adapter to be formed from two pieces (FIGS. 11–13). Similarly, to the Stanley-Bostitch tool, the cavity 38 is formed in both the body 22 and the cap 44. The shape of the cavity 38 is not the same as the Stanley-Bostitch tool and the adapters are not interchangeable.

The adapter 30 for the Craftsman tool receives a face plate 18 which is dove-tailed between two opposing bent arms 46. The cavity 38 is defined as the space between the bent arms 46 extending between the top and the bottom of the body 22.

The adapter 20 for the SENCO tool is made of one piece. The adapter 10 has a movable tab 47 mounted on the back face 30. The tab 47 may be moved or rotated so that the tab 47 provides access to the cavity 38 for receipt of the face plate 18 of the fastener driving tool 10. When the face plate 18 is disposed on the cavity 38, the tab 47 is moved or rotated to project over the face plate 18 so that the adapter 20 is secured to the face plate 18. The adapter for the SENCO tool is not interchangeable with the adapter for any of the other fastener driving tools.

FIGS. 23–26 show the method of using the present invention. The siding 48 to be installed on the structure 50 may be aluminum or vinyl. Each length of siding 48 has a plurality of spaced-apart open lateral slots 52 formed near the top edge. Below the lateral slots 52, a lateral ridge 54 is formed. The distance between the lateral slots 52 and the lateral ridge 54 is not uniform for all manufacturers of siding. Accordingly, the adjustable jaw 34 is abutted to the lateral ridge 50 on the siding 48, the opening 42 in the body 22 is directly opposite the lateral slots 52 in the siding 48. This setting is changed only when the siding being installed has a different spacing between the lateral slots 52 and the lateral ridge 54. The setting is changed by moving the threaded fasteners 36 to provide a desired spacing between the lip 32 and the adjustable jaw 34.

The fastener driving tool 10 with the adapter 20 is disposed on the siding 48 as described above and is moved laterally until the adapter is aligned between the edges of a selected lateral slot 52.

Figure 20:
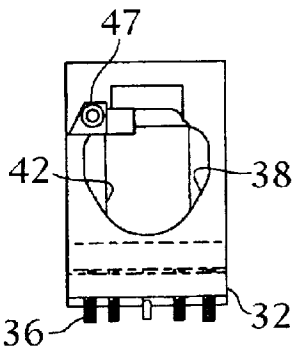
FIG. 20 is a plan view of the back face of the adapter of FIG. 18 showing the tab moved to secure the face plate in the cavity.
Figure 19:
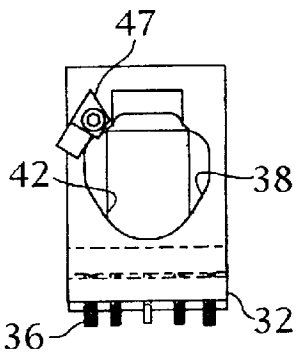
FIG. 19 is a plan view of the back face of the adapter of FIG. 18 showing the tab moved to provide access to the cavity.
Figure 18:
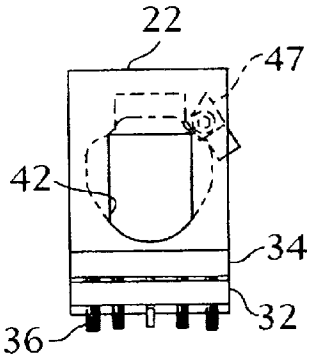
FIG. 18 is a plan view of the front face of an adapter for a fastener driving tool made by SENCO.
Figure 23:
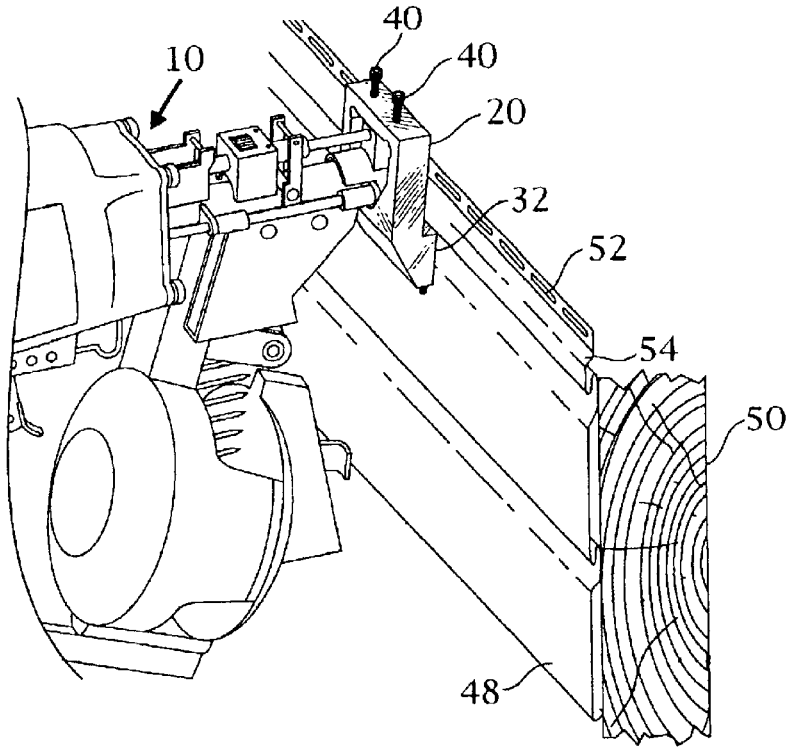
FIG. 23 is a perspective view of the fastener driving tool with the adapter placed abutting the lateral ridge on the siding.
Figure 24:
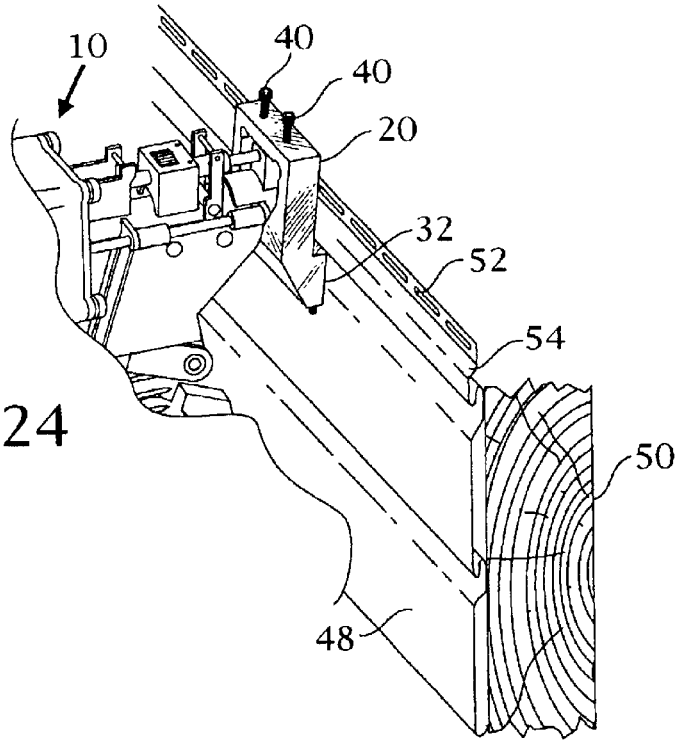
FIG. 24 is a perspective view showing the alignment of the adapter with the lateral slots in the siding.
Figure 25:
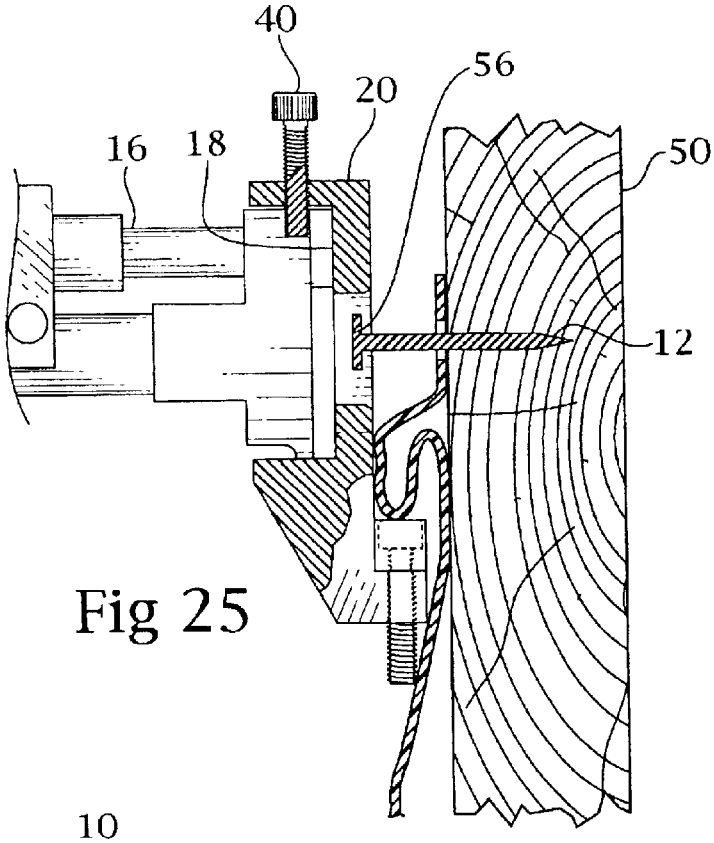
FIG. 25 is a cross section view showing the fastener driven into the slot in the siding with the head spaced apart from the structure.
Figure 26:
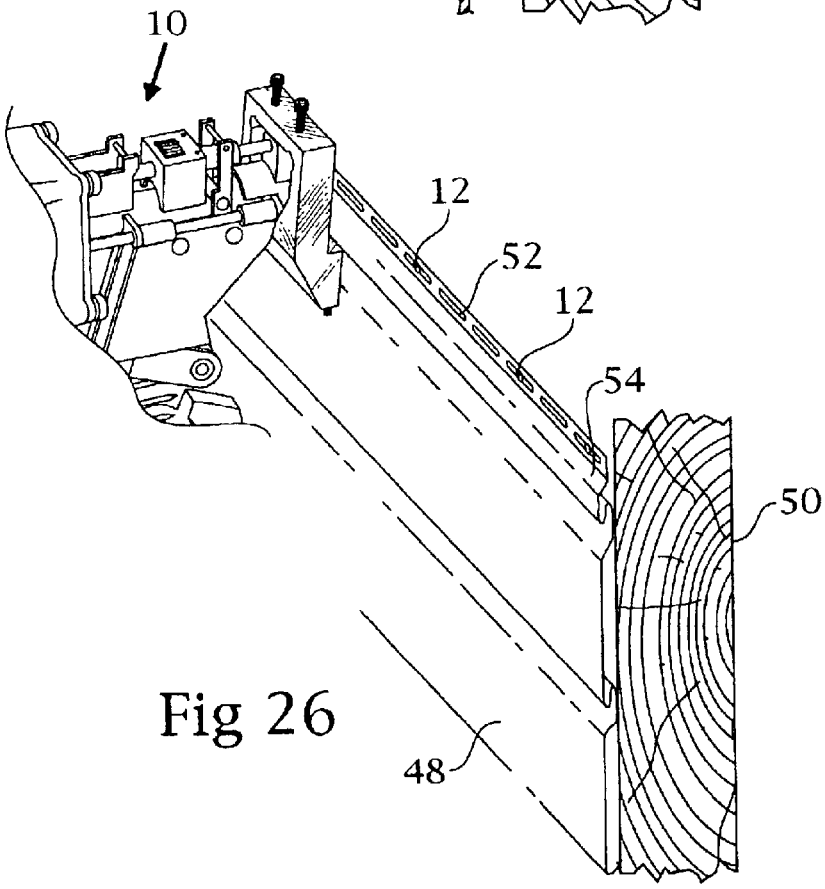
FIG. 26 is a perspective view of the adapter attached to the fastener driving tool moved to a spaced-apart lateral slot on the siding.

The trigger 14 on the fastener driving tool 10 is activated wherein a fastener 12 is dispensed from the storage in the tool. The head of the fastener 12 is impacted by the movable driver 16 and the shank of the fastener is driven through the opening in the face plate 18, through the opening 42 in the body 22 of the adapter and through the lateral slot 52 into the structure 50. The fastener driving tool 10 is designed so the movable driver 16 is moved to approximately the outer face of the face plate 18 and does not extend beyond the face plate 18. Thus, the head 56 of the fastener 12 is driven only to the outer face of the face plate and is spaced apart a predetermined distance from the structure 50. This predetermined distance is a function of the thickness of the siding 48 and the thickness of the body 22 of the adapter 20 between the front face 28 and the back face 30 (FIG. 20). The head 56 of the fastener 12 is not flush with the siding 48 and the siding 48 has freedom of movement to contract and expand with changes in temperature. Also, the lateral ridge 54 on the siding 48 is undamaged.

The installation of the siding is continued by moving the fastener driving tool opposite another lateral slot 52 in the siding 48. The adjustable jaw 34 or the jaw 32 is abutted to the lateral ridge 54 and the adapter is aligned with the lateral slot. The trigger is activated and another fastener is driven into the selected lateral slot in the siding. The procedure is repeated to install the section of siding and another section of siding is installed above the initial section of siding.

In this manner, the siding is installed very rapidly reducing the man hours to install the siding. Also, the siding is undamaged. The present invention provides a means to improve the versatility of a fastener driving tool such as a roofing gun.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An adapter attached to a fastener driving tool for installing siding on a structure comprising in combination:

the fastener driving tool having a movable driver, the fastener driving tool having a face plate on an end thereof, the face plate having an opening therein, the adapter having a top, a bottom, a front face, an opposite back face and a thickness between the front face and the back face, a cavity formed in the back face of the adapter, an opening formed in the cavity in the adapter between the front face and the back face, the face plate being received in the cavity in the adapter, the opening in the adapter being aligned with the opening in the face plate, a plurality of fasteners stored within the driving tool, means for automatically sequentially introducing one of the plurality of fasteners to the movable driver, each fastener having a head and a sharpened shank, a trigger connected to the driving tool, wherein activating the trigger moves the movable driver against the head of the fastener to drive the shank of the fastener through the opening in the face plate, through the opening in the adapter, through a slot in the siding, wherein the head of the fastener is stopped at a predetermined distance from the structure, further comprising a jaw formed on the front face of the adapter near the bottom thereof, the jaw being capable of engaging a lateral ridge on the siding.

2. An adapter attached to a fastener driving tool for installing siding on a structure comprising in combination:

the fastener driving tool having a movable driver, the fastener driving tool having a face plate on an end thereof, the face plate having an opening therein, the adapter having a top, a bottom, a front face, an opposite back face and a thickness between the front face and the back face, an opening formed in the adapter between the front face and the back face, the opening being aligned with the opening in the face plate, a plurality of fasteners stored within the driving tool, each fastener having a head, means for automatically sequentially introducing one of the plurality of fasteners to the movable driver, each fastener having a head and a sharpened shank, a trigger connected to the driving tool, wherein activating the trigger moves the movable driver against the head of the fastener to drive the shank of the fastener through the opening in the face plate, through the opening in the adapter, through a slot in the siding, wherein the head of the fastener is stopped at a predetermined distance from the structure, further comprising a jaw formed on the front face of the adapter near the bottom thereof, the jaw being capable of engaging a lateral ridge on the siding, wherein the jaw has an adjustable jaw disposed on an upper side thereof, there being means to adjustably space the adjustable jaw from the jaw toward the top of the adapter.

3. An adapter attached to a fastener driving tool for installing siding on a structure comprising in combination:

the fastener driving tool having a movable driver, the fastener driving tool having a face plate on an end thereof, the face plate having an opening therein, the adapter having a top, a bottom, a front face, an opposite back face and a thickness between the front face and the back face, a cavity formed in the back face of the adapter, an opening formed in the cavity in the adapter between the front face and the back face, the face plate being received in the cavity in the adapter, the opening in the adapter being aligned with the opening in the face plate, a plurality of fasteners stored within the driving tool, means for automatically sequentially introducing one of the plurality of fasteners to the movable driver, each fastener having a head and a sharpened shank, a trigger connected to the driving tool, wherein activating the trigger moves the movable driver against the head of the fastener to drive the shank of the fastener through the opening in the face plate, through the opening in the adapter, through a slot in the siding, wherein the head of the fastener is stopped at a predetermined distance from the structure, means for removably connecting the adapter to the face plate of the fastener driving tool wherein the face plate cooperates with the adapter, wherein the means for removably connecting the adapter to the face plate is a movable tab connected to the back face of the adapter, the tab being movably disposed over the face plate when the face plate is received in the cavity in the back face of the adapter to secure the adapter to the face plate.

4. An adapter for use with a fastener driving tool for installation of siding on a structure, comprising in combination:

the adapter having a body having a top, a bottom, a front face, a back face, and a thickness between the front face and the back face, a jaw formed on the front face of the body near the bottom thereof, the jaw capable of abutting and engaging a lateral ridge in the siding for aligning the adapter to the siding, a cavity formed in the back face of the body, a through opening between the front face and the back face of the body communicating with the cavity, and means for removably attaching the adapter to the fastener driving tool.

5. An adapter for use with a fastener driving tool for installation of siding on a structure, comprising in combination:

the adapter having a body having a top, a bottom, a front face, a back face, and a thickness between the front face and the back face, a jaw formed on the front face of the body near the bottom thereof, a cavity formed in the back face of the body, a through opening between the front face and the back face of the body communicating with the cavity, and means for removably attaching the adapter to the fastener driving tool, wherein the fastener driving tool has a face plate formed on an end thereof, the face plate having a three-dimensional configuration, the cavity in the back face of the body of the adapter having a cooperating three-dimensional configuration wherein the face plate is received in the cavity.

6. The adapter of claim 5, wherein the cavity in the back face of the body is formed between two opposing bent arms extending between the top and the bottom of the body, the face plate on the movable driver being received and retained between the opposing bent arms.

7. The adapter of claim 5, wherein the means for removably attaching the adapter to the fastener driving tool is a movable tab connected to the back face of the adapter, the tab being movably disposed over the face plate when the face plate is received in the cavity.

8. An adapter for use with a fastener driving tool for installation of siding on a structure, comprising in combination:

the adapter having a body having a top, a bottom, a front face, a back face, and a thickness between the front face and the back face, a jaw formed on the front face of the body near the bottom thereof, a cavity formed in the back face of the body, a through opening between the front face and the back face of the body communicating with the cavity, and means for removably attaching the adapter to the fastener driving tool, wherein the jaw has an adjustable jaw disposed on an upper side thereof, the adjustable jaw having means thereon to adjustably space the adjustable jaw from the jaw toward the top of the body.

9. An adapter for use with a fastener driving tool for installation of siding on a structure, comprising in combination:

the adapter having a body having a top, a bottom, a front face, a back face, and a thickness between the front face and the back face, a jaw formed on the front face of the body near the bottom thereof, a cavity formed in the back face of the body, a through opening between the front face and the back face of the body communicating with the cavity, and means for removably attaching the adapter to the fastener driving tool, wherein the means for removably attaching the adapter to the fastener driving tool is at least one threaded fastener received in at least one cooperating threaded opening in the adapter, the at least one threaded fastener extending through the adapter and securing the face plate of the fastener driving tool in the cavity in the adapter.

10. An adapter for use with a fastener driving tool for installation of siding on a structure, comprising in combination:

the adapter having a body having a top, a bottom, a front face, a back face, and a thickness between the front face and the back face, a jaw formed on the front face of the body near the bottom thereof, a cavity formed in the back face of the body, a through opening between the front face and the back face of the body communicating with the cavity, and means for removably attaching the adapter to the fastener driving tool, further comprising the body having a cap removably connected to the top of the body, the cavity in the back face of the adapter extending into the cap and the body of the adapter.

11. An adapter attached to a fastener driving tool for installing siding on a structure comprising:

the adapter having a fixed jaw formed on a front face thereof, an adjustable jaw disposed on the front face of the adapter, there being means to adjustably space the adjustable jaw from the fixed jaw wherein the jaws are capable of engaging a lateral ridge of the siding, a plurality of fasteners being stored within the fastener driving tool, each fastener having a head, means for driving the fastener toward the siding and means for stopping the head of the fastener a predetermined distance from the siding.

* * * * *